US006478173B2

(12) United States Patent
Carlstedt

(10) Patent No.: US 6,478,173 B2
(45) Date of Patent: Nov. 12, 2002

(54) RAILROAD CAR DRAFT GEAR HAVING A LONG TRAVEL

(75) Inventor: Richard A. Carlstedt, Wheaton, IL (US)

(73) Assignee: Miner Enterprises, Inc., Geneva, IL (US)

( * ) Notice: Subject to any disclaimer, the term of this patent is extended or adjusted under 35 U.S.C. 154(b) by 0 days.

(21) Appl. No.: 09/782,114

(22) Filed: Feb. 13, 2001

(65) Prior Publication Data

US 2002/0108920 A1 Aug. 15, 2002

(51) Int. Cl.[7] ..... B61G 9/18
(52) U.S. Cl. ..... 213/32 C; 213/32 R
(58) Field of Search ..... 213/32 C, 35, 213/36, 22, 32 R

(56) References Cited

U.S. PATENT DOCUMENTS 2,147,034 A * 2/1939 Heitner ..... 213/22
2,592,732 A * 4/1952 Peterson ..... 213/32 R
3,708,075 A * 1/1973 LaBelle ..... 213/22
3,741,406 A * 6/1973 Anderson ..... 213/22
4,591,059 A * 5/1986 Hammarlund ..... 213/32 R
5,312,007 A * 5/1994 Kaufhold et al. ..... 213/75 R

* cited by examiner

*Primary Examiner*—S. Joseph Morano
*Assistant Examiner*—Frantz F. Jules
(74) *Attorney, Agent, or Firm*—John A. Schaerli

(57) ABSTRACT

A friction/elastomeric pad draft gear to cushion and absorb impacting forces on a railroad car coupler system. The friction/elastomeric pad draft gear includes a housing with a closed end and an open opposite end with a major axis extending therebetween. The open opposite end is provided with inwardly tapered extended internal friction surfaces. A wedge is mounted for axial movement in the open end of said housing and friction devices are positioned within the housing between the wedge and the extended internal friction surfaces. A spring seat is positioned adjacent the friction devices and on top of the elastomeric pad stack. The friction devices engagement with the wedge: forms a first selected angle of about 35 degrees ±3 degrees; forms a second selected angle of about 2.25 degrees, ± about 0.25 degrees, with the extended tapered internal friction surface; and forms a third selected angle of about 90 degrees, ±4 degrees, with the spring seat, all in respect to the major axis.

16 Claims, 8 Drawing Sheets

RAILROAD CAR DRAFT GEAR HAVING A LONG TRAVEL

BACKGROUND OF THE INVENTION

1. Field of the Invention

The present invention relates to draft gears and, in particular, to an improved friction/elastomeric pad draft gear having an extended travel for the absorption and dissipation of input forces.

2. Prior Art

Coupler systems for modern railroad cars typically have included a draft gear assembly to cushion and absorb forces placed on the system during car operation. Devices to cushion and absorb such forces may comprise an elastomeric spring package coupled with a frictional restraint device.

Examples of such devices are exemplified by U.S. Pat. Nos. 4,556,149 and 4,591,059 both of which are assigned to the assignee of the present invention and incorporated by reference herein.

While such draft gear devices have high shock absorbing capacities they tend to transmit a high magnitude of force to the car structure during a work cycle.

SUMMARY OF THE INVENTION

The present invention overcomes the disabilities of the prior art by providing a friction/elastomeric pad draft gear which absorbs energy over a longer distance of travel than prior art devices thereby enabling the transmission of lower levels of force to the rail car structure when cushioning a given energy input. In accordance with friction/elastomeric pad draft gears, the present invention includes a housing with a closed end and an open opposite end which is provided with an extended tapered internal friction surface. A wedge is mounted for axial movement in the open end of the housing and is situated for direct application of draft or buff forces. Friction devices or stepped friction shoes are positioned within the housing, between the wedge and the extended tapered internal friction surface to absorb some of the shock created by the application of a force to the wedge. A spring seat is positioned between the friction devices and the elastomeric pad stack. The stepped friction shoes cooperate with the spring seat to increase the available space for the elastomeric pad stack. A guide spike is secured to the closed end of the housing and passes through the elastomeric pad stack, spring seat and wedge to lessen the potential of buckling of the pad column.

The friction devices of this invention include a series of annularly spaced friction shoes each having a first, flat beveled inner surface in engagement with a flat beveled inner surface of the wedge. The beveled inner surfaces are formed at a first selected angle with respect to the major axis of the housing. Each of the friction shoes also has a second flat, beveled outer face in engagement with the extended tapered internal friction surface, located in the open end of the housing, forming a second selected angle with the major axis of the housing. Each of the friction shoes also has a third flat, inner face in engagement with a flat, outer face formed in the spring seat, the third flat inner face of the shoe and the outer face of the spring seat being formed at a third selected angle with respect to the major axis of the housing. The guide spike is held stationary at all times as a result of the head of the spike being kept tight against the rear wall of the housing by virtue of the preload to which the elastomeric pad is subjected. A pilot hole through the center of the spring seat and through the center of the wedge enables inward displacement of the wedge and spring seat while maintaining the spike's central alignment.

In the preferred embodiment of the invention, the first selected angle of the adjoining surfaces of the friction shoe and the wedge is approximately 35 degrees plus or minus about 3 degrees. The second selected angle of the adjoining surfaces of the friction shoe and the extended tapered internal friction surface is approximately 2.25 degrees plus or minus about 0.25 degrees. The third selected angle of the adjoining surfaces of the friction shoe and the spring seat surface is approximately 90 degrees plus or minus about 4 degrees. The elastomeric pad stack comprises a plurality of concentric springs which are made in accordance with U.S. Pat. Nos. 4,198,037 and 4,566,678 which are incorporated by reference herein.

Thus, an object of this invention is the provision of a draft gear wherein the available travel to installed length ratio is about 0.21. The ratio of the available travel to the installed length of modern draft gears has heretofore ranged from about 0.11 to about 0.16 with the vast majority having a ratio of about 0.14.

Still a further object of the invention is to provide a draft gear which employs friction/elastomeric devices, fits in a standard pocket, and has 120 mm of travel. This extent of travel having been possible heretofore only with expensive hydraulic draft gears.

An additional, object of this invention is to provide a draft gear for application in a standard pocket which has 120 mm of travel, weighs less and can absorb more energy than a conventional draft gear.

Another object of this invention is to provide a stepped friction shoe in combination with a spring seat whereby allowing a longer elastomeric spring column to be located within the draft gear housing.

DESCRIPTION OF THE DRAWINGS

Other features and advantages of the invention will become apparent in the following description of the preferred embodiment taken in conjunction with the drawings, in which.

DESCRIPTION OF THE PREFERRED EMBODIMENT

Figure 1:
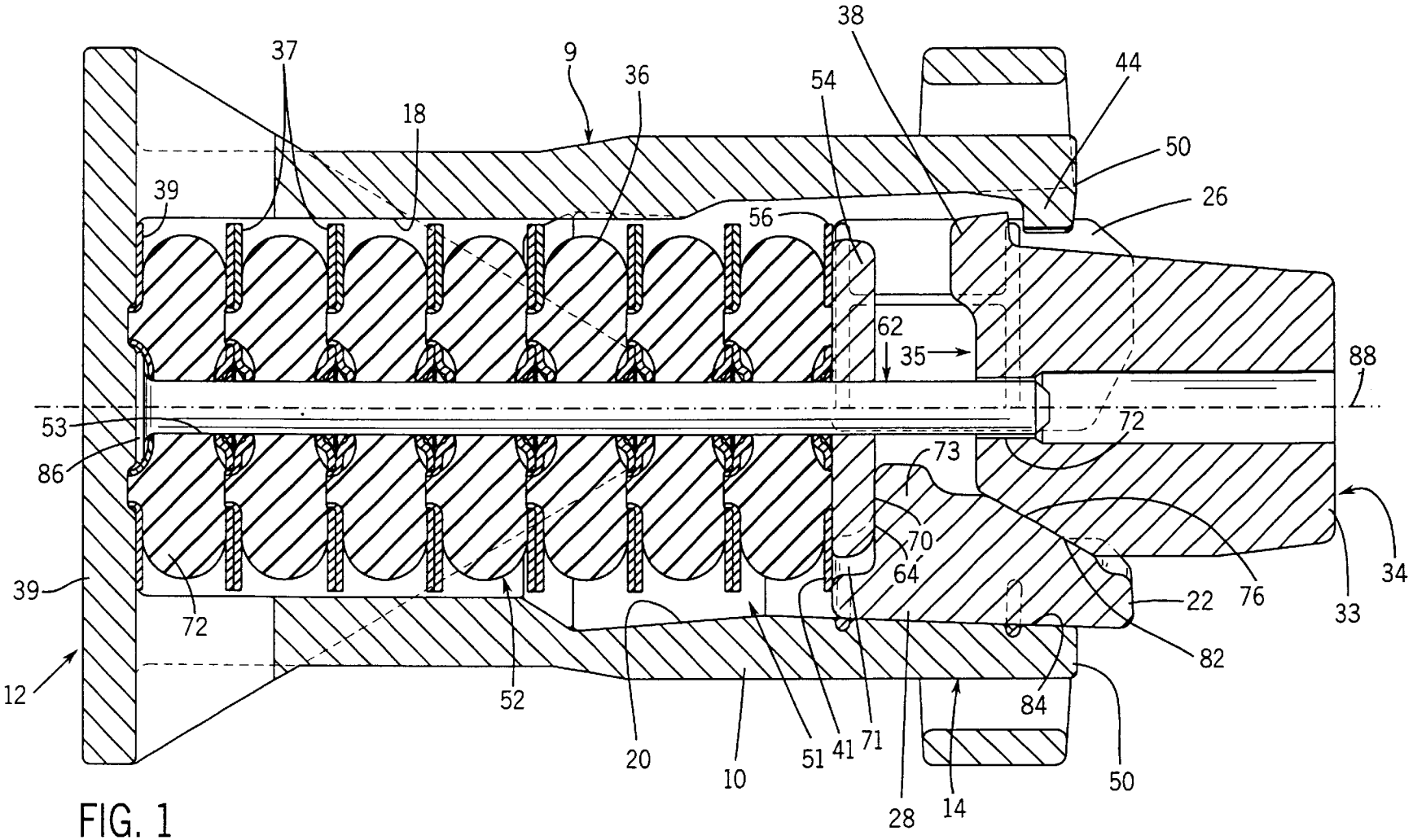
FIG. 1 is a longitudinal cross-sectional illustration of one form of a draft gear embodying principals of the present invention.

As illustrated in the drawings, a friction/elastomeric pad draft gear 9, according to the present invention, includes an axially bored or hollow housing or casing 10 with a first end being open and an opposed second end being closed by a fixed, enlarged end wall or plate 12. The housing 10 is provided, adjacent its open end 50, with a thick walled friction shell section 14 having three longitudinally extended and tapered internal or inner friction surfaces 28, 30 and 32 (FIG. 2); with each tapered surface converging toward the closed end of the housing 10 and with the extended and tapered internal friction surface, generally identified by reference numeral 28 in FIG. 1, being representative of any one of the three inner friction surfaces 28, 30 and 32 on housing 10. Spaced longitudinally or axially inwardly inward of the shell section 14, the housing 10 is provided with an internal bore 18 which opens to the first end of housing 10 and terminates at the end wall 12. As shown in FIG. 1, that portion of the housing 10 longitudinally or axially spaced inwardly from the shell section 14 is characterized by a thinner wall section and by a generally cylindrical inner configuration. The shell section 14 and the bore 18 are integrally interconnected by a transition wall section 20 which serves to blend the configuration of the shell section 14 and the bore 18 into each other.

Figure 2:
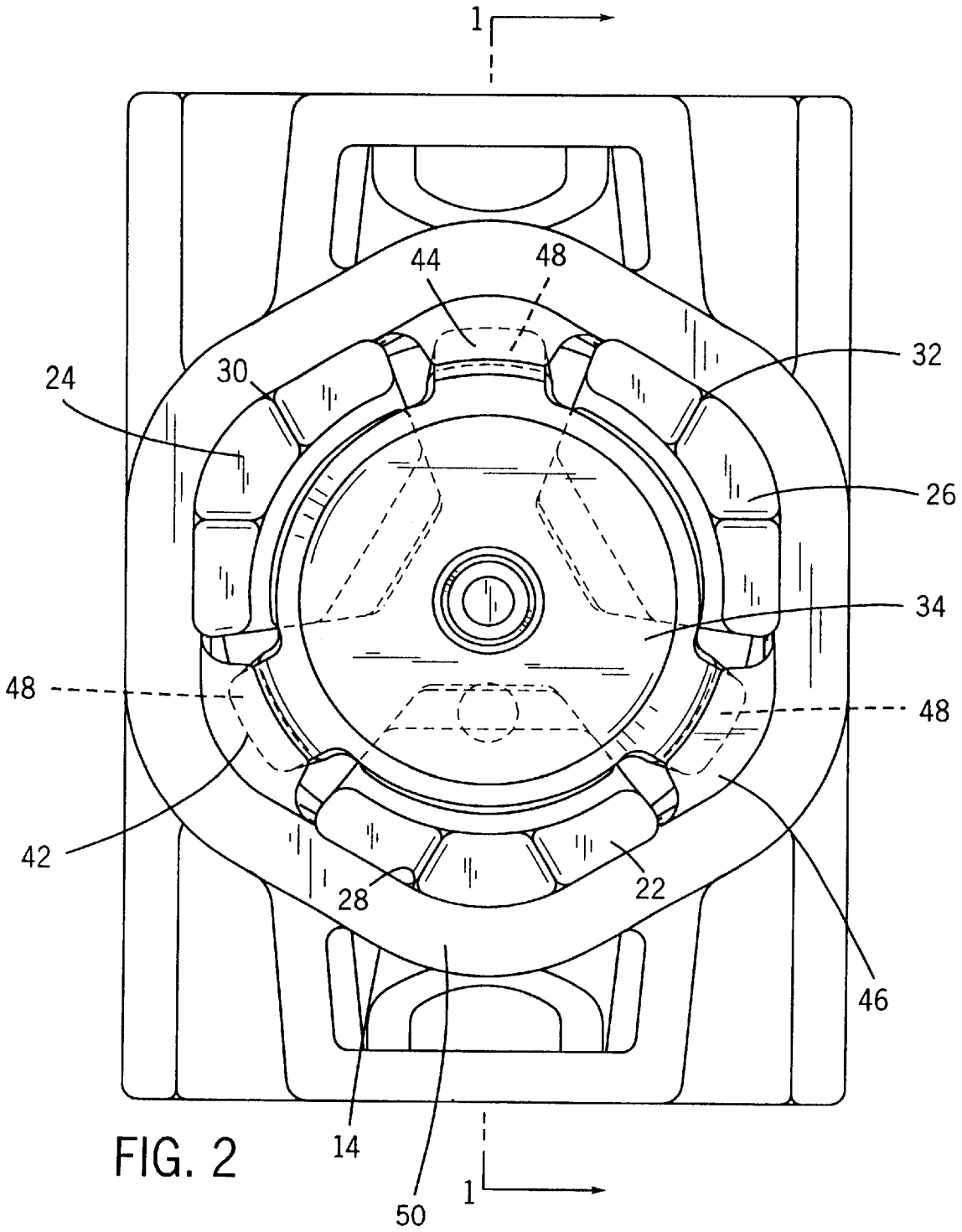
FIG. 2 is a front elevational view of the draft gear illustrated in FIG. 1.
Figure 3:
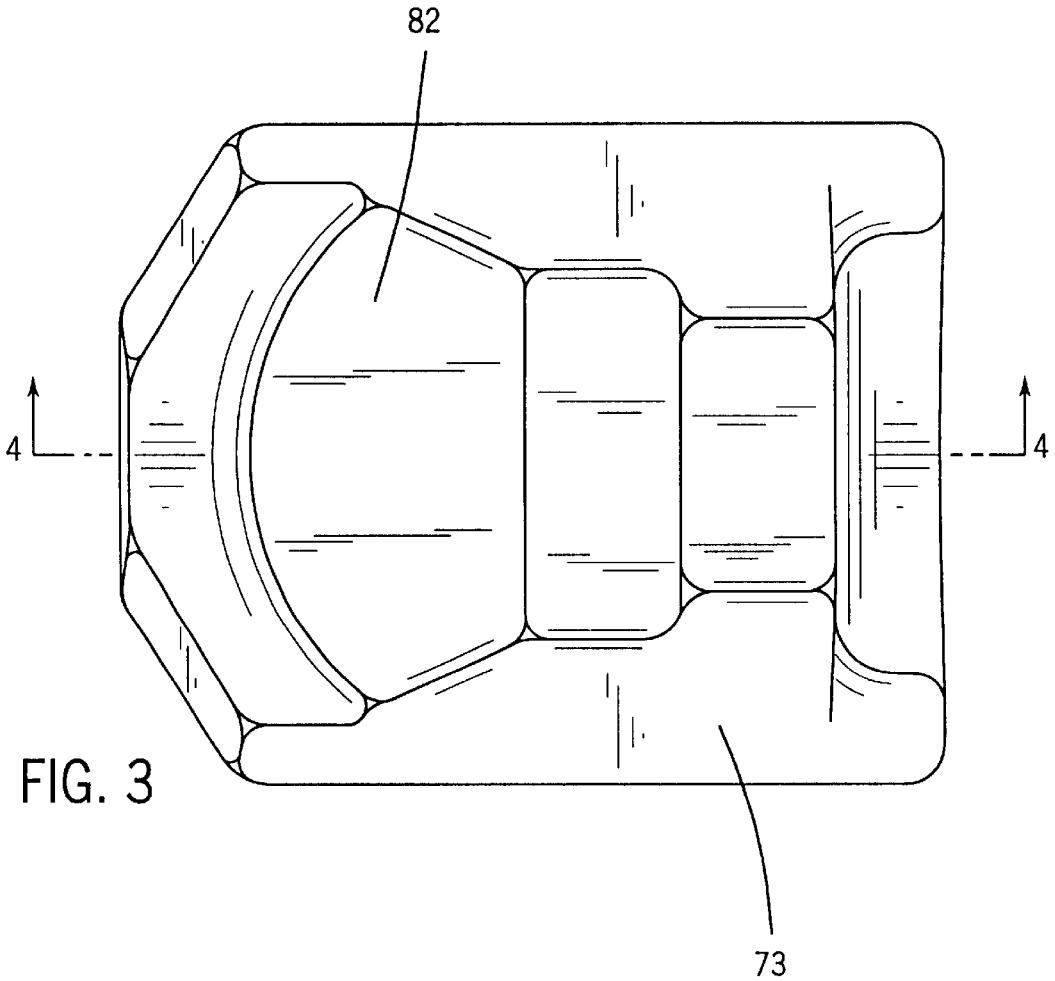
FIG. 3 is a plan view of an inner or inside surface of a friction shoe forming part of the draft gear illustrated in FIG. 1.
Figure 4:
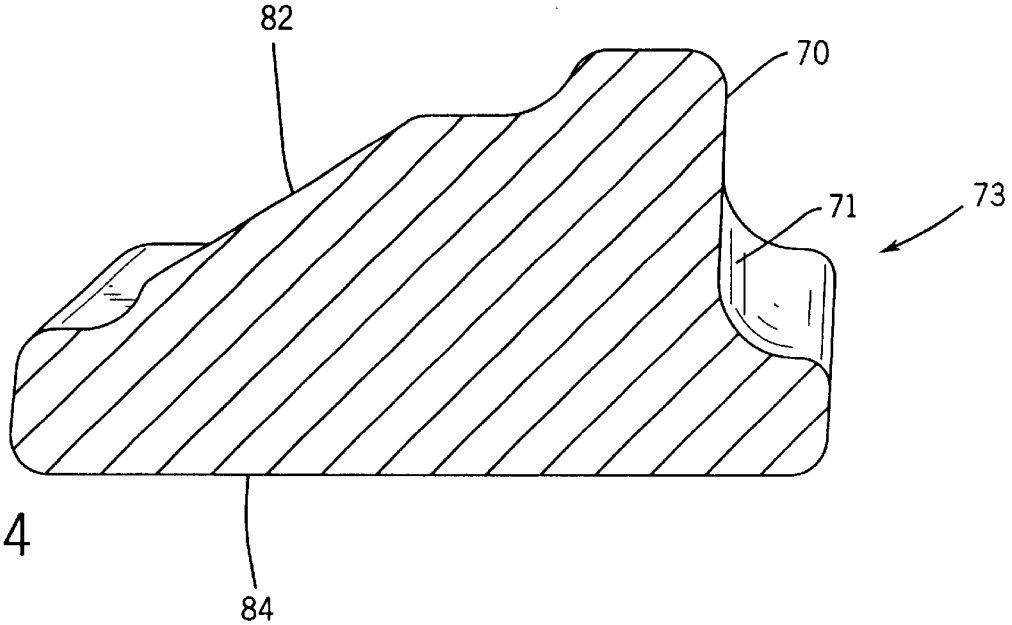
FIG. 4 is a cross sectional view of the friction shoe taken along line 4—4 of FIG. 3.
Figure 5:
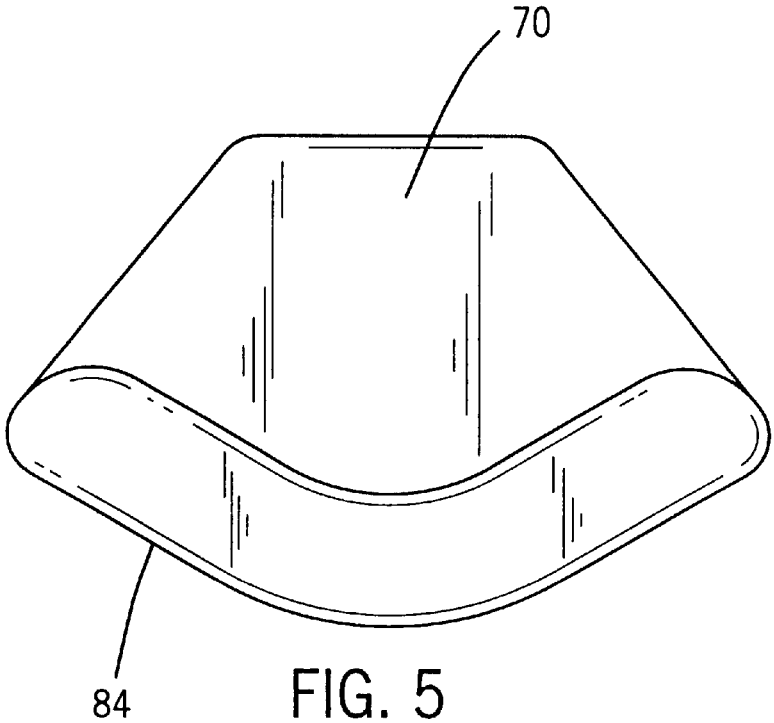
FIG. 5 is a back end elevational view of the friction shoe of FIG. 3.
Figure 6:
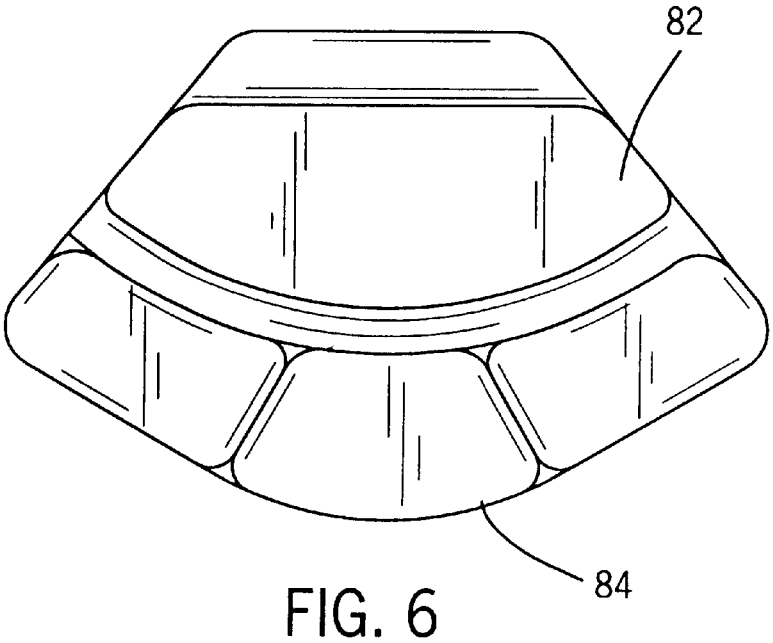
FIG. 6 is a front end elevational view of the friction shoe of FIG. 3.
Figure 7:
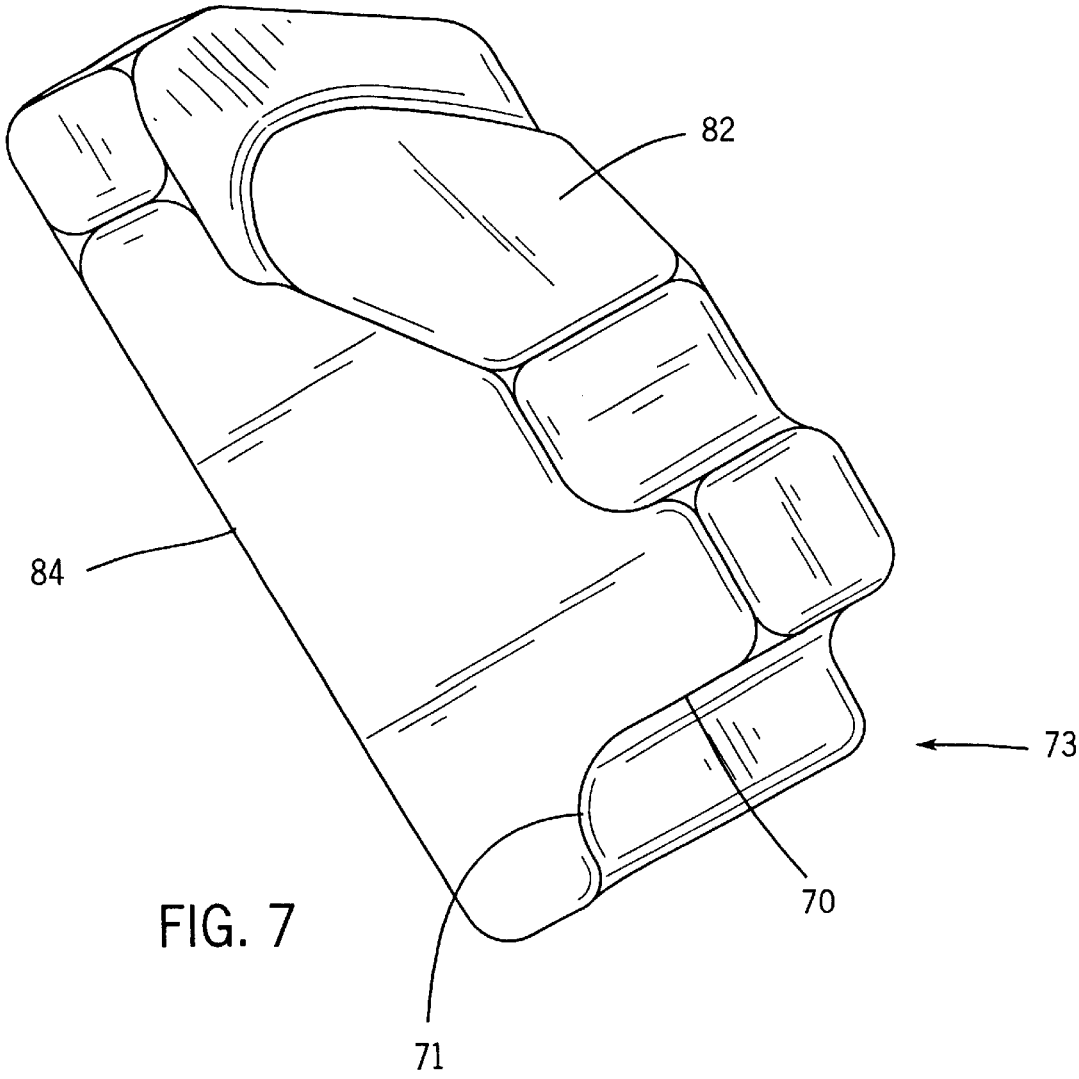
FIG. 7 is a side elevational view of the fricton shoe of FIG. 3.
Figure 10:
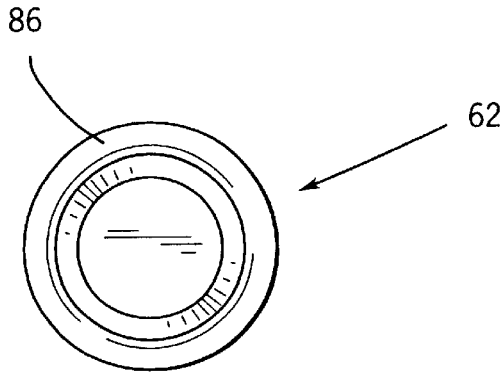
FIG. 10 is a front elevational view of a guide forming part of the draft gear illustrated in FIG. 1.

As is conventional, a series of three friction shoes 22, 24 and 26 are circumferentially spaced as shown in FIG. 2 in the shell section 14 in sliding friction-producing engagement with associated extended tapered internal friction surfaces 28, 30 and 32 of the shell section 14. The three friction shoes 22, 24 and 26 when assembled as shown, define an outwardly opening pocket for receiving the inner end 35 of a wedge 34.

In addition to the resistance developed in the shell section 14 during inward movement of the friction shoes 22, 24 and 26 and the wedge 34, an elastomeric spring 36 comprised of a resilient material is provided in the internal bore 18 of housing 10. Such resilient material, because it was precompressed during assembly, maintains the wedge and friction shoes in operative engagement with each other and within the housing, both during the operation of the draft gear, as well as during periods of non-operation. The resilient material also resists inward movement of the friction shoes 22, 24 and 26 to cushion some of the draft forces applied to the draft gear.

To retain the wedge 34 and the friction shoes 22, 24 and 26 in the open end 50 of the housing 10, a series of circumferentially spaced flanges 38, 40 and 42 (FIG. 2) are provided toward an inner end 35 of the wedge 34. In the illustrated embodiment, each flange 38, 40 and 42 radially projects outwardly from the wedge 34 with an opening being provided between adjacent flanges 38, 40 and 42. In the illustrated embodiment, housing 10 is provided with a corresponding number of circumferentially spaced inwardly projecting lugs 44, 46 and 48 at its open end 50. In the illustrated embodiment, each lug 44, 46 and 48 radially projects inwardly toward the major axis of the housing 10 with an opening being provided between adjacent lugs so as to permit the wedge flanges 38, 40 and 42 to move axially therepast. During assembly of the draft gear the wedge flanges 38, 40 and 42 are moved past and, ultimately, arranged behind or axially inwardly of the housing lugs 44, 46 and 48 so the wedge 34 and the friction shoes 22, 24 and 26 are positively retained in assembled relationship in the housing 10. As will be appreciated by those skilled in the art, and after the wedge 34 is assembled in the draft gear 10, the wedge flanges 38, 40 and 42 are inhibited from rotating into alignment with the openings between adjacent housing lugs 44, 46 and 48 due in part to the forces generated by the preload to which the elastomeric pad stack 36 is subject.

The elastomeric spring 36 is formed from a resilient material and, in a preferred form, is comprised of a series or longitudinal stack of concentric elastomeric springs, generally identified by reference numeral 52 in FIG. 1. Preferably, each elastomeric spring or pad in the stack 52 has a centrally disposed pilot hole or throughbore, generally identified by reference numeral 53 in FIG. 1. As shown, the axially innermost elastomeric pad or spring in the elastomeric spring stack 52 is seated against the inner face of the end wall 12. The individual pads are stacked such that the pilot hole 53 in each pad comprising the elastomeric spring stack 52 is substantially aligned with the pilot hole 53 in the adjacent elastomeric pad in the spring stack whereby a single center pilot hole extends through the entire pad stack 52. Further, each individual pad is preferably provided with metal plates 37 and 39 preferably secured to opposed parallel surfaces, as shown in FIG. 1. As will be more filly explained, the metal plate 39 of the axially innermost elastomeric pad or spring in the elastomeric spring stack 52 aids in securing an axially innermost end of an elongated guide 62 which longitudinally extends away from the end wall or plate 12 of housing 10. In the illustrated embodiment, the metal plate 37 of the elastomeric spring or pad closest to the open end 50 of the housing 10 abuts with a heel portion 73 of each friction shoe 22, 24 and 26. In a preferred embodiment, the elastomeric pad stack 52 is manufactured in accordance with U.S. Pat. Nos. 4,198,037 and 4,566,678, although other suitable resilient material could be used without detracting or departing from the spirit and scope of the present invention.

Figure 8:
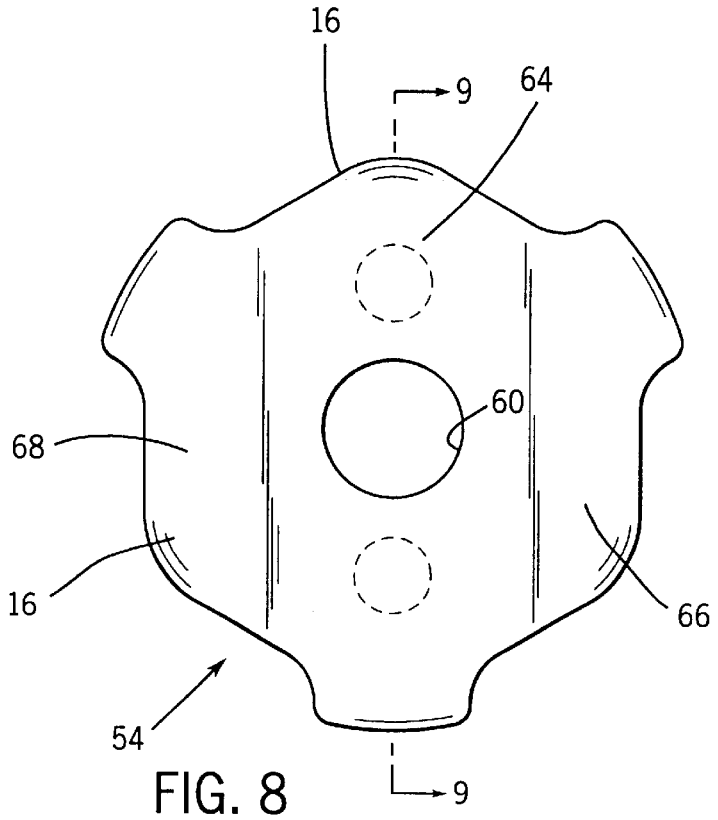
FIG. 8 is an outer elevational view of a spring seat forming part of the draft gear illustrated in FIG. 1.
Figure 9:
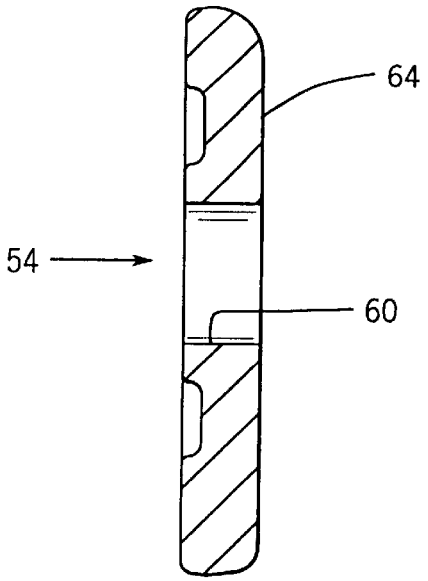
FIG. 9 is a cross sectional view of the spring seat taken along line 9—9 of FIG. 8.

A generally flat symmetrically contoured spring seat 54 is disposed between the outer end 56 of the elastomeric pad stack 36 and the inner end 70 of the friction shoes 22, 24 and 26, and is adapted for longitudinal movement in the housing 10 to compress the pad stack 36, when force is applied to the wedge 34. The center hole 60 in the spring seat 54, accommodates and stabilizes the guide spike 62 and allows for the spring seat's movement during a work cycle. As shown in FIG. 8 the spring seat 54 includes first, second and third flat, outer faces 64, 66 and 68. First outer face 64, for example, which cooperates with the third flat, inner face 70, of friction shoe 22, as shown in FIG.1, to form a third selected angle of about 90 degrees plus or minus 4 degrees with respect to the major axis 88 of the draft gear 9. Although not shown, each of the flat outer faces 66 and 68 cooperate with the flat inner faces of friction shoes 24 and 26 (not shown). As seen in FIG.1 the spring seat 54 fits into a recess 71 created in the bottom portion 73 of the friction shoe 22. Although not shown, each friction shoe 24 and 26 also have such a recess or step in the bottom or heel portion. This arrangement provides more space in the internal transition section 20 and bore section 18 for additional elastomeric pad material and thus allows a more elastic spring column having greater energy absorption.

Each of the friction shoes 22, 24 and 26 are the same in size, shape and function and, thus, discussion will be limited to friction shoe 22 with the understanding that such description equally applies to friction shoes 24 and 26. In other words, friction shoes 24 and 26 include flat faces corresponding to face 70, recess or steps 71, and heel portions 73, and etc. as described above regarding shoe 22. Suffice it to say, each friction shoe 22, 24 and 26 includes a first preferably flat, beveled or tapered inner angling surface 82, a second preferably flat, beveled or tapered outer angling surface 84, and a third preferably flat, inner face 70.

The wedge 34 has a series of circumferentially and equally spaced, preferably flat outer surfaces 76, 78 and 80 all of which are the same in size, shape and function and, thus, discussion will be limited to the preferably flat angling outer surface 76 on wedge 34 as seen in FIG. 1 with the understanding such description equally applies in full to flat outer surfaces 78 and 80 on the wedge 34. After the draft gear 9 is assembled, the flat outer surface 76 slidably engages with the first preferably flat, beveled inner surface 82 of the friction shoe 22 forming a first select angle of about 35 degrees plus or minus 3 degrees with the major axis 88 of the draft gear 9.

As previously discussed, the thick-walled friction shell section 14 of housing 10 has three equally spaced and longitudinally extending tapered internal or inner friction surfaces 28, 30 and 32 all being the same in size, shape and function and, thus, discussion will be limited to the tapered internal or inner friction surface 28 on housing 10 with the understanding that such description equally applies to the other two tapered internal or inner friction surfaces 30 and 32 on housing 10. The extended tapered internal or inner friction surface 28 on housing 10 slidably engages with the second flat, beveled or angled surface 84 on friction shoe 22 whereby forming a second selected angle of about 2.25 degrees plus of or minus 0.25 degrees with the major axis 88 of the draft gear 9. In order to provide the draft gear 9 with an unconventional axial or longitudinally extended travel, the extended tapered internal or inner friction surface 28 on housing 10 longitudinally extends is about 5.5 inches or 140 mm in length. As schematically represented in FIG. 1, the longitudinally extended inner angled surface 28 extends from the open end 50 of housing 10 to an area, generally represented in FIG. 1 by reference numeral 51, which is spaced a significant longitudinal or axial distance inwardly from the open end 50 of housing 10.

The guide spike 62 is held stationary at all times by virtue of the head portion 86 thereof being compressed tight against the end wall 12 by the fact that the elastomeric pad stack 36 has a preload. During a work cycle the pilot hole 53 of the elastomeric pad stack 36, the center hole 60 of the spring seat 54 and center bore 72 of the wedge 34 move relative to the spike 62, enabling inward displacement of the wedge 34 and spring seat 54. The guide spike 62 is sized to be approximately 0.25 inches shorter than the inside length of the housing to allow the follower block (not shown) to butt against the end 50 of the draft gear at full travel, without damaging the spike 62.

The draft gear 9 described and illustrated herein also has a working stroke of about 116 mm to about 120 mm. The working stroke is the amount of travel of the gear 9 and is the distance the outer face 33 of wedge 34 moves with respect to the open end 50 during a work cycle.

A further characteristic of the draft gear 9 is the available travel to installed length ratio. This term is the working stroke divided by the distance from the outer face 33 of wedge 34 to the outer surface 39 of the end plate 12. As an approximation, dividing about 118 mm by the distance from the outer face 33 to the outer surface 39 which is approximately 568.4 mm results in an available travel to installed length ratio of about 0.21.

Figure 11:
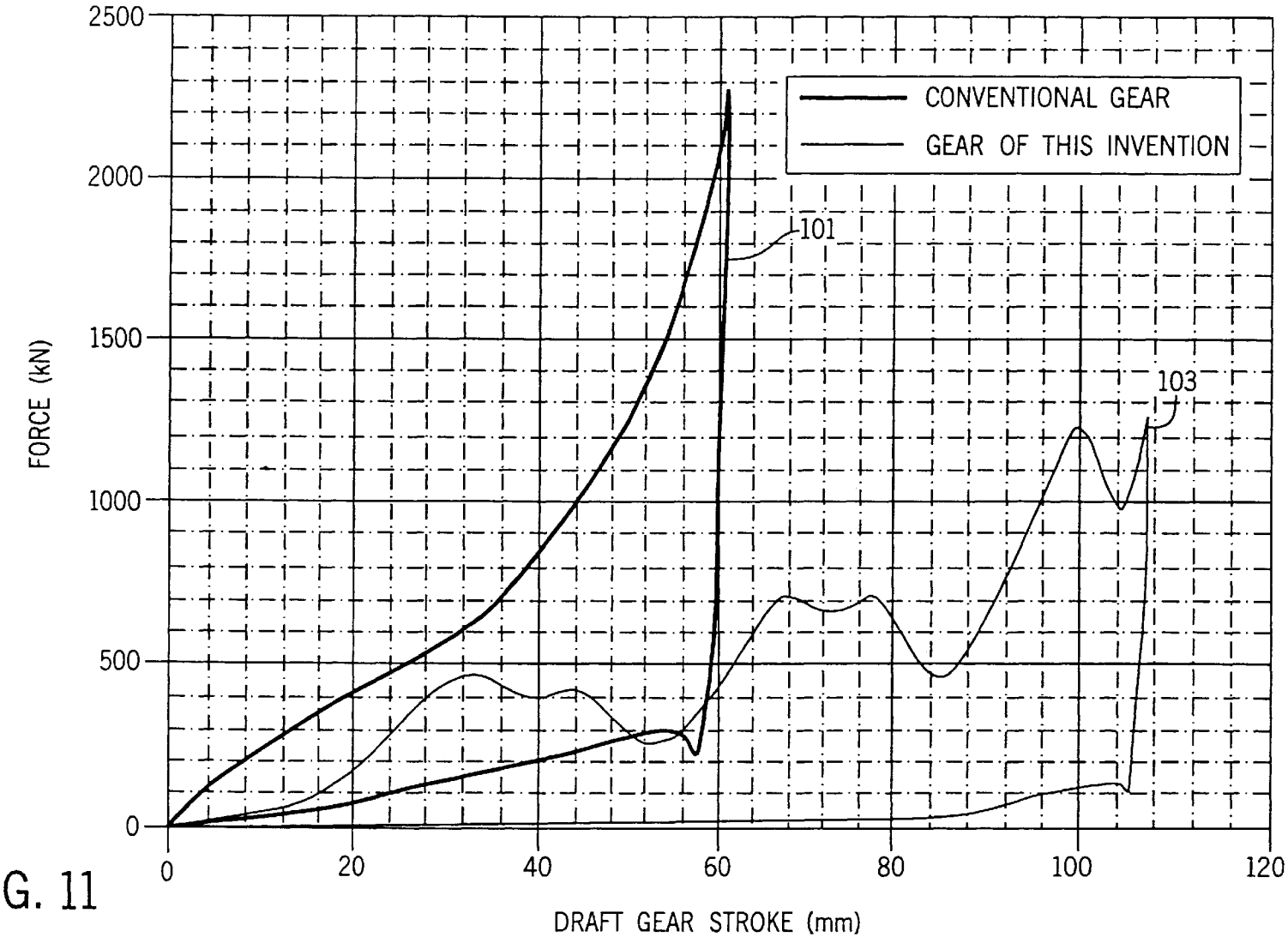
FIG. 11 is a diagrammatic comparison between the force vs. draft gear stroke of a conventional draft gear and a draft gear embodying principals of the present invention, for the same energy input.
Figure 12:
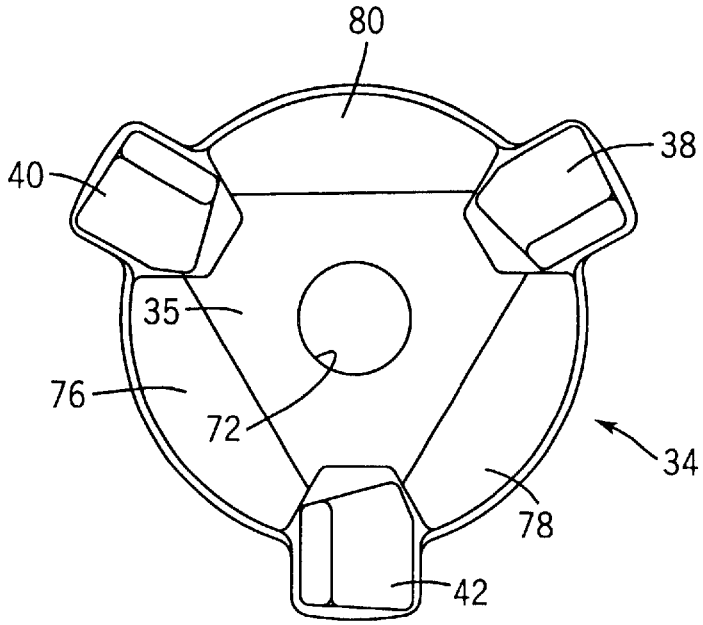
FIG. 12 is an inside elevational illustration of a wedge forming part of the draft gear illustrated in FIG. 1.
Figure 13:
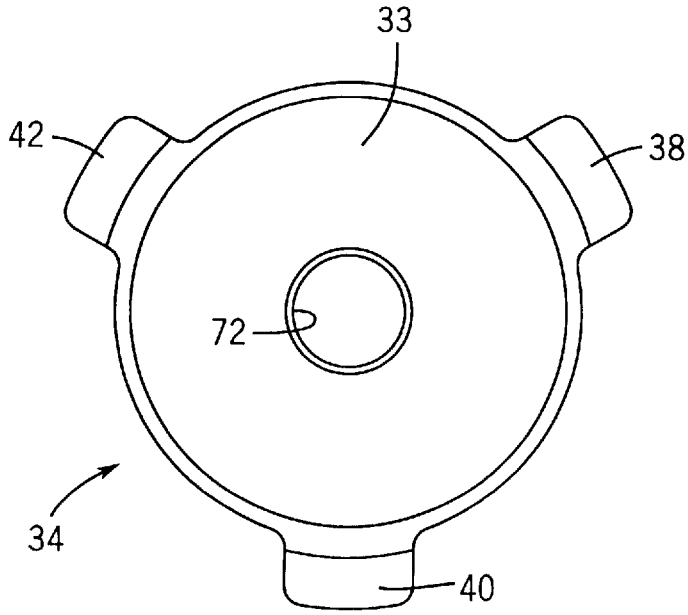
FIG. 13 is a outside elevational illustration of the wedge shown in FIG. 12.

Still a further characteristic of the draft gear of this invention is its ability to cushion an impact and transmit a low level of force in doing so. It can be seen from FIG. 11 that when a mass having kinetic energy strikes a conventional elastomer/friction draft gear, a certain force/travel relationship 101 results. When that same mass, having the same kinetic energy, strikes the draft gear described herein, the resulting force/travel relationship 103 is characterized by a generally lower level of force, that is, spread over a greater range of travel. As would be expected, the work done by either draft gear in cushioning the impact of the moving mass is the same and is confirmed by the same total area beneath the upper graph line and the horizontal axis for either force/travel relationship. By taking advantage of a greater working stroke, the draft gear of this invention can transmit less force to the car structure while dissipating the same energy.

While embodiments of this invention have been shown and described, it should be understood that this invention is not limited hereto except by the scope of the claims. Various modifications and changes may be made without departing from the scope and spirit of the invention as the same will be understood by those skilled in the art.

I claim:

1. A friction/elastomeric draft gear comprising:

hollow housing open at a first end and closed toward a second end, said housing defining a major axis and having a series of extended tapered inner surfaces opening toward and longitudinally extending from a front portion arranged adjacent the first end of said housing, a series of friction members equally and annularly spaced about said major axis, each friction member including a first end portion with a first angled surface, a second end portion, and an outer surface between said first and second end portions, with said outer surface being configured to complement one of said extended tapered inner surfaces provided on said housing and such that a first sliding surface is cooperatively defined between the outer surface of each friction member and one of said extended tapered inner surfaces on said housing, with said first sliding surface between the outer surface of each friction member and the extended tapered inner surface on said housing defining an angle of about 2.25 degrees, plus or minus about 0.25 degrees, relative to the major axis of said housing, a wedge arranged for axial movement relative the open end of said housing and against which an external force can be applied, said wedge defining a series of outer tapered surfaces configured to complement the first angled surface at the first end portion of each friction member and such that a second sliding surface is cooperatively defined between the outer tapered portions on said wedge and the first angled surface of each friction member, and with the second sliding surface defined between the outer tapered portions on said wedge and the first angled surface of each friction member defining an angle of about 35 degrees, plus or minus 3 degrees, relative to the major axis of said housing;

a spring seat arranged within and at a generally normal disposition relative to the major axis of said housing, said spring seat defining on one side thereof a face configured to complement and engage a second surface arranged adjacent the second end portion of each friction member, and such that a third surface is defined at the conjuncture of the face on said spring seat and the second surface on each friction member, with said third surface being disposed as to define an angle of about 90 degrees, plus or minus 4 degrees, relative to the major axis of said housing;

an elastomeric spring disposed within said hollow housing between the closed end of said housing and a side of said spring seat opposed to said one side for storing energy generated during compression of said draft gear; and wherein said elastomeric spring in combination with the configuration of said housing, said wedge, said friction shoes and said spring seat along with the angularity of said first sliding surface, said second sliding surface and said third surface relative to the major axis of said housing permit said draft gear to resist impact forces applied thereto while cushioning said impact forces over an extended range of operation exceeding 3.5 inches in either axial direction.

2. The friction/elastomeric draft gear according to claim 1, wherein the second end portion of each friction member in said series of annularly spaced friction members define a recess.

3. The friction/elastomeric draft gear according to claim 1, wherein said spring seat axially fits into said recess defined by said friction members.

4. The friction/elastomeric draft gear according to claim 3, further including an elongated guide longitudinally extending from and secured to the closed end of said housing.

5. The friction/elastomeric draft gear according to claim 4, wherein said elastomeric spring comprises a series of elastomeric pads arranged in stacked relation relative to each other, with each elastomeric pad defining a pilot hole, and wherein said spring seat includes defines a center hole, and with said wedge defining a center bore open at opposite ends, and wherein said guide passes endwise through the pilot hole in each elastomeric pad, through the center hole defined by said spring seat, and at least partially through the center bore defined by said wedge thereby promoting axial compression/expansion of said elastomeric spring when forces are axially applied to and relieved from said wedge.

6. The friction/elastomeric draft gear according to claim 1, wherein each extended tapered inner surface on said housing extends from the open end toward the closed end of said housing and is about 140 mm in length.

7. The friction/elastomeric draft gear according to claim 1, wherein said elastomeric spring is under a preload.

8. The friction/elastomeric draft gear according to claim 7, wherein said guide is secured to said closed end of said housing by said elastomeric spring subject to a preload.

9. The friction/elastomeric draft gear according to claim 8, wherein the second end portion of each friction member contacts both said spring seat and said elastomeric spring.

10. A friction/elastomeric draft gear comprising:

a hollow housing open at a first end and closed toward a second end, said housing defining a major axis and having a series of longitudinally extended tapered inner surfaces opening toward and longitudinally extending from a front portion arranged adjacent the first end of said housing;

a series of equally and annularly spaced friction shoes arranged for limited radial movement relative to the major axis of said housing, with each friction shoe including a first end portion with a first inner angled surface, a second end portion, and an outer surface between said first and second end portions, with the outer surface of each friction shoe being slidably engagable with one of the respective radially opposed longitudinally extended tapered inner surfaces on said housing, and wherein said outer surface for each friction shoe and the radially opposed longitudinally extended tapered inner surface on said housing each being disposed in a plane defining a first selected angle relative to the major axis of said housing;

a wedge arranged for axial movement relative the open end of said housing, said wedge having a free end extending outwardly beyond the first end of said housing and against which an external force can be applied, said wedge defining a series of outer tapered surfaces which engage and slide along the first inner angled surface on each friction shoe, with the outer tapered surfaces on the wedge and the first inner angled surface on each friction shoe each being disposed in a plane defining a second selected angle relative to the major axis of said housing, and with the wedge defining a generally centrally disposed axial bore open at opposite ends;

a spring seat arranged within and at a generally normal disposition relative to the major axis of said housing, said spring seat defining on one side thereof a face which engages a surface disposed adjacent the second end portion on each friction shoe, with the face on said spring seat and the surface disposed adjacent the second end portion of each friction shoe each being disposed in a plane defining a third selected angle relative to the major axis of said housing, and with said spring seat defining a generally centrally disposed throughbore;

an elastomeric spring within said hollow housing between the closed end of said housing and a side of the spring seat opposed to said one side whereby said spring package stores energy applied to said wedge during compression of said draft gear; said elastomeric spring including a series of elastomeric pads arranged in stacked relation relative to each other, with each elastomeric pad in said stack defining a centralized bore extending therethrough;

a guide extending from the closed end and extending toward the open end of said housing, said guide passing endwise through the centralized bore in the elastomeric pads comprising said elastomeric spring, through the centralized bore in said spring seat, and at least partially through the throughbore in said wedge for promoting axial contraction/expansion of said elastomeric spring in response to the axial forces applied to said draft gear, and wherein said elastomeric spring in combination with the configuration of said housing, said wedge, said friction shoes and said spring seat along with the angularity of said first selected angle, said second selected angle and said third selected angle permitting said draft gear to resist impact forces applied thereto while cushioning said impact forces over an extended range of operation exceeding an axial cumulative length in excess of 7 inches.

11. The friction/elastomeric draft gear according to claim 10, wherein the second end portion of each friction shoe in said series of annularly spaced friction shoes defines a recess, and wherein said spring seat fits axially into the recess of each friction shoe, and wherein the second end portion of each friction shoe contacts both said elastomeric spring and said spring seat.

12. The friction/elastomeric draft gear according to claim 10, wherein:

a. said first selected angle is about 2.25 degrees, plus or minus about 0.25 degrees, b. said second selected angle is about 35 degrees, plus or minus about 3 degrees; and c. said third selected angle is about 90 degrees, plus or minus about 4 degrees.

13. The friction/elastomeric draft gear according to claim 10, wherein:

a. said elastomeric spring comprises a series of annular elastomeric pads arranged in stacked relation relative to each other, and with each elastomeric pad having a pilot hole;

b. said wedge defines a center bore;

c. the second end portion of each friction shoe defines a recess;

d. said spring seat defines a center hole; and further including e. an axially elongated guide longitudinally extending from the closed end of said housing and passing through the pilot hole in each elastomeric pad in said stack, through said center hole defined in said spring seat, and at least partially through said center bore defined by said wedge.

14. The friction/elastomeric draft gear according to claim 13, wherein said spring seat fits axially into the recess of each friction shoe, and wherein the second end portion of each friction shoe contacts both said elastomeric spring and said spring seat.

15. A fiction/elastomeric draft gear comprising:

a hollow housing open at a first end and closed toward a second end, said housing defining a major axis and having a series a series of longitudinally extended tapered inner surfaces opening toward and longitudinally extending from a front portion arranged adjacent the first end of said housing, and wherein the first and second ends of said housing define generally parallel surfaces with a predetermined length therebetween;

a series of annularly spaced friction shoes, each friction shoe including a first end portion with a first angled surface and a second end portion and an outer surface between said first and second end portions, with the outer surface of each friction shoe being slidably engagable with one of the respective radially opposed longitudinally extended tapered inner surfaces on said housing, and wherein said outer surface for each friction shoe and the radially opposed longitudinally extended tapered inner surface on said housing each being disposed in substantially matching relation relative to each other and in a plane defining a first selected angle relative to the major axis of said housing;

a wedge arranged for axial movement relative the open end of said housing, said wedge having a free end extending outwardly beyond the first end of said housing a distance of about 118 mm when said draft gear is at a full operative length and against which an external force can be applied, said wedge defining an outer tapered portion which combines with said first inner angled surface on each friction shoe to urge said shoes radially outward relative to the major axis of said housing upon compression of said draft gear;

a spring seat arranged within and at a generally normal disposition relative to the major axis of said housing, said spring seat defining on one side thereof a face which combines with said second end portion on each friction shoe and which defines a third selected angle relative to the major axis of said housing;

an elastomeric spring within said hollow housing between the closed end of said housing and a side of the spring set opposed to said one side whereby said spring package store energy applied to said wedge during compression of said draft gear from said fill operative length, with said elastomeric spring being compressed under a preload; and wherein the angles provided between said housing, said friction shoes, said wedge, and said spring seat are such that said draft gear provides a working stroke of about 118 mm and an available travel to installed length ratio of about 0.21.

16. The friction/elastomeric draft gear according to claim 15, wherein:

a. said first selected angle is about 2.25 degrees, plus or minus about 0.25 degrees;

b. said second selected angle is about 35 degrees, plus or minus about 3 degrees; and c. said third selected angle is about 90 degrees, plus or minus about 4 degrees.

* * * * *